US005513467A

United States Patent [19]

Current et al.

[11] Patent Number: 5,513,467

[45] Date of Patent: May 7, 1996

[54] LINEAR DRIVE POWER DOOR OPERATOR

[75] Inventors: Andrew Current, Oglesby; Craig Lucas, Princeton, both of Ill.

[73] Assignee: Schlage Lock Company, San Francisco, Calif.

[21] Appl. No.: 453,863

[22] Filed: May 30, 1995

[51] Int. Cl.[6] ..... E05F 15/10

[52] U.S. Cl. ..... 49/340; 49/139; 74/89.15

[58] Field of Search ..... 49/340, 341, 139; 74/127, 89.15

[56] References Cited

U.S. PATENT DOCUMENTS

| | | | |
|---|---|---|---|
| 3,394,499 | 7/1968 | Korthaus et al. | 49/340 |
| 3,874,117 | 4/1975 | Boehm | 49/340 X |
| 4,040,144 | 8/1977 | Lasier et al. | 16/66 |
| 4,348,835 | 9/1982 | Jones et al. | 49/340 X |
| 4,375,735 | 3/1983 | Rhoads | 49/68 |
| 4,394,787 | 7/1983 | Lieberman | 16/58 |
| 4,419,787 | 12/1983 | Lieberman | 16/65 |
| 4,878,265 | 11/1989 | Nesbit | 16/49 |
| 5,018,304 | 5/1991 | Longoria | 49/340 |
| 5,040,331 | 8/1991 | Merendino et al. | 49/340 X |
| 5,375,374 | 12/1994 | Rohroff, Sr. | 49/340 |

*Primary Examiner*—Philip C. Kannan
*Attorney, Agent, or Firm*—Keith F. Noe; Robert F. Palermo

[57] ABSTRACT

A linear drive power door operator selectively and automatically opens and closes a door swingably mounted on a door jamb. The door operator includes a power screw disposed within a housing and a drive which powers the rotation of the power screw for moving a piston having a threaded bore threadably engaging the power screw linearly upon activation of the drive. A rack having teeth is engaged by the piston for moving the rack linearly from end-to-end. The power door operator further includes a pinion having teeth threadably engaging the teeth of the rack. The pinion is rotatable about a vertical axis upon the side-to-side linear movement of the rack. At least one link arm is pivotally connected at one of its ends to the pinion and pivotally connected at its other end to the door. A control device controls the operation of the drive for moving the door between a closed position and an open position. The control device activates the drive for moving the piston and the rack from a first position in which the door is closed to a second position in which the door is fully open, and any position in between.

16 Claims, 4 Drawing Sheets

LINEAR DRIVE POWER DOOR OPERATOR

BACKGROUND OF THE INVENTION

This invention generally relates to automatic door openers, and more particularly to a linear drive power door operator for selectively and automatically opening and closing a door swingably mounted on a door jamb.

In 1991, rules promulgated pursuant to the Americans with Disabilities Act (ADA) require that certain public buildings must remove barriers and provide people with disabilities access equal to, or similar to, that available to the general public. One area covered by these rules is the provision of accessible door openings. The ADA requires, among other things, door openings at least thirty-two inches wide, easily manipulated door handles, a maximum opening force for opening doors, a minimum closing time, and doors capable of opening at least ninety degrees. Automatic door openers have been developed in order to meet the standards set by the ADA and to give people with disabilities equal access to buildings.

The present invention is in the same general field as the door assister disclosed in U.S. Pat. No. 4,040,144 to Lasier et al. and represents improvements thereover. The door assister disclosed in this patent includes a rack and pinion arrangement for lessening the force required to open a door. More particularly, the door assister includes a pneumatic and hydraulic arrangement which powers the rack when a person applies a small opening force on the door for reducing the opening force required to open the door. One problem associated with this type of door opener is that due to its relatively complex nature (i.e., in that it requires pneumatic components, including a compressor), it is relatively expensive to assemble and install.

The foregoing illustrates limitations known to exist in present door opening and closing assemblies. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a linear drive power door operator for selectively and automatically opening and closing a door swingably mounted on a door jamb. The power door operator comprises an elongate closer body housing mounted on the door frame along a generally horizontal axis, and a power screw disposed within the closer body housing which also extends along the horizontal axis. A drive powers the rotation of the power screw about the horizontal axis for moving a piston having a threaded bore threadably engaging the power screw linearly along the horizontal axis upon activation of the drive and the rotational movement of the power screw. A rack having teeth is engaged by the piston for moving the rack linearly from side-to-side. The power door operator further comprises a pinion having teeth threadably engaging the teeth of the rack. The pinion is rotatable about a vertical axis upon the side-to-side linear movement of the rack. At least one link arm is pivotally connected at one of its ends to the pinion and pivotally connected at its other end to the door. A control device controls the operation of the drive for moving the door between a closed position and an open position. The control device activates the drive for moving the piston and the rack from a first position in which the door is closed to a second position in which the door is fully open, and any position in between.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
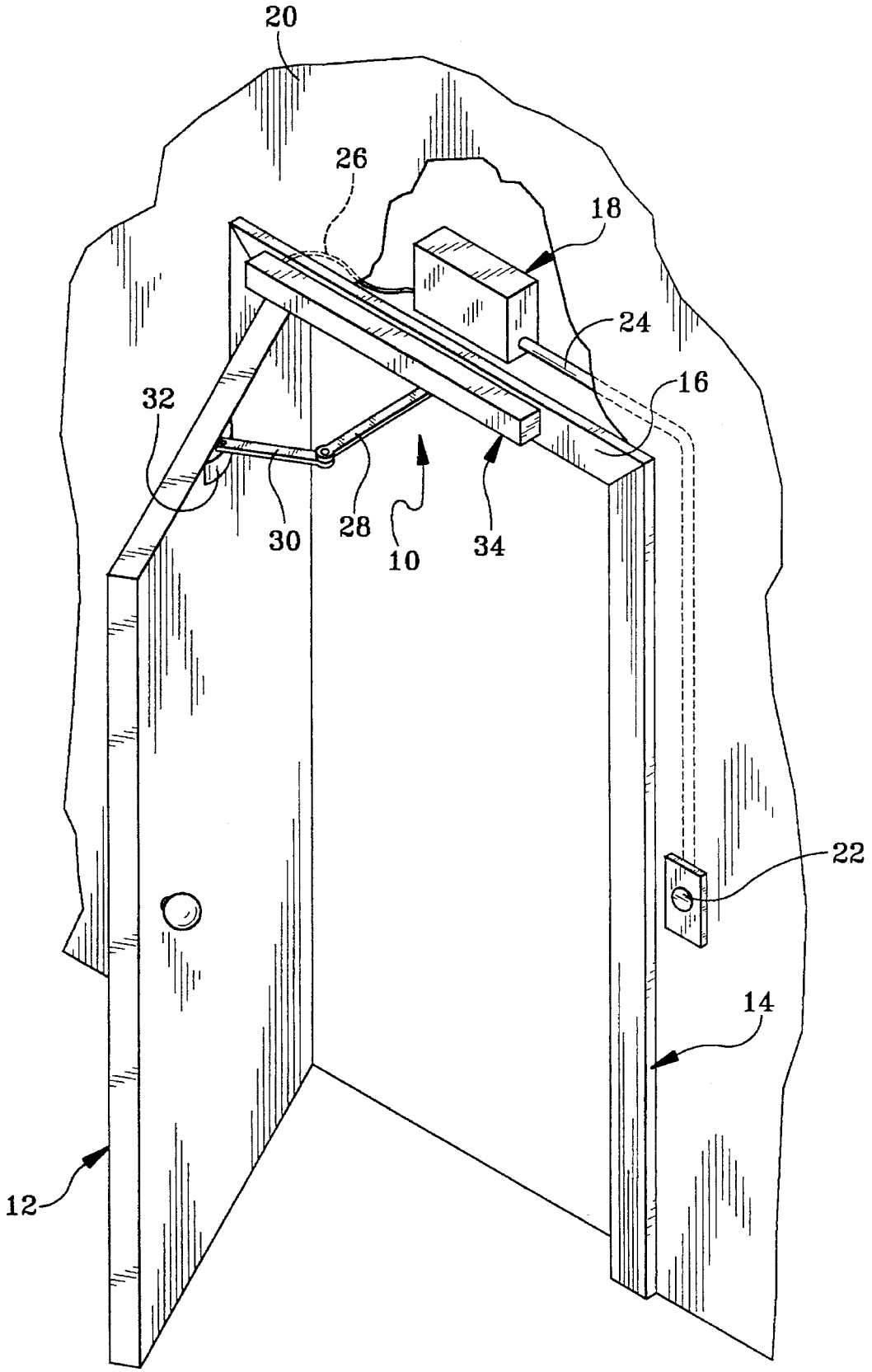
FIG. 1 is a perspective, environmental view with portions removed of a door swingably mounted on a door jamb which is selectively and automatically opened and closed by a linear drive power door operator of a preferred embodiment of the present invention.

Referring now to the drawings, wherein similar reference characters designate corresponding parts throughout the several views, the embodiment of the apparatus shown in FIG. 1 comprises a linear drive power door operator 10 according to one embodiment of the invention. More specifically, the power door operator 10 is provided for selectively and automatically opening and closing a door, generally indicated at 12, swingably mounted on a door frame (as by hinges, not designated), generally indicated at 14.

FIG. 1 illustrates the power door operator 10 of the present invention mounted on the top door frame member 16 for opening and closing the door 12. It should be noted that the power door operator 10 instead of being mounted on the exterior of the top door frame member 16 can be mounted within the door frame 14 if it is desired to conceal it. The power door operator 10 is in electrical communication with a control device, generally indicated at 18, which as illustrated is housed interiorly within a wall 20 on which the door frame 14 is mounted. The control device 18 may alternatively be provided within the ceiling or attached to the operator or other suitable locations. The control device 18 includes a microprocessor for controlling the operation of the power door operator 10 to open the door 12. In the shown embodiment, the control device 18 is in electrical communication with a switch 22 provided on the wall 20 located adjacent the door frame 14. Suitable wires 24, 26 connect the switch 22, control device 18 and door operator 10 to one another in the well-known manner. The arrangement is such that a handicapped person, for example, desiring to enter through the door opening need only press the switch 22 for activating the power door operator 10 which opens the door 12. Another embodiment (not shown) can be to place a sensor in front of the door 12 and have it automatically open upon being triggered by a person standing in front of the door 12. However, one advantage to the shown embodiment is that a person may open the door 12 manually or press the switch 22 for automatically opening it.

The power door operator 10 is connected to a first link arm 28 at an end thereof. The first link arm 28 is pivotally connected to a second link arm 30 at an opposite end thereof which is attached to the door 12 by a bracket 32. By rotating the first link arm 28 in a clockwise direction as illustrated in FIG. 1, the door 12 is opened. Thus, the power door operator 10 of the shown embodiment is capable of providing a clockwise rotating force on the first link arm 28 for opening the door 12. It should be understood that the power door operator 10 can be designed for providing a counterclockwise force on the first link arm 28 instead of a clockwise force in situations where the door 12 opens in an opposite direction and still fall within the scope of the present invention. It should also be understood that the provision of two link arms 28, 30 is merely illustrative since one link arm slidably connected within a track (not shown) mounted on the door is well-known in the art of door openers and closers.

Figure 2:
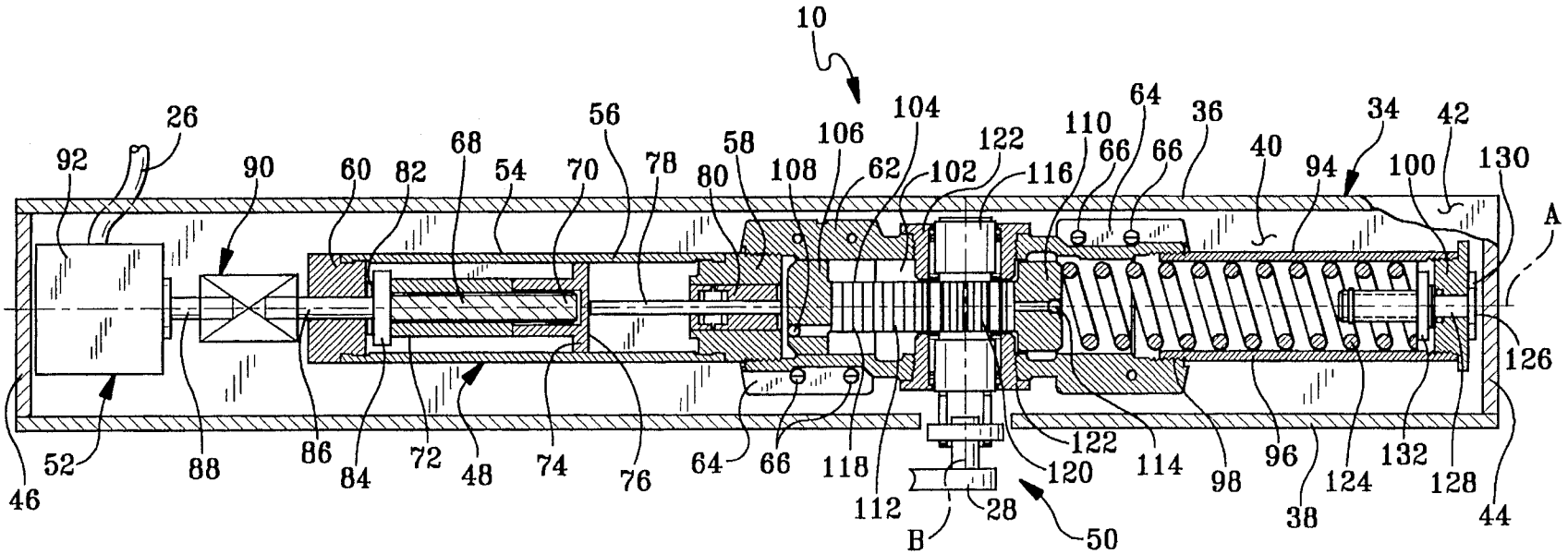
FIG. 2 is an enlarged, partial cross section elevational view of the power door operator illustrated in FIG. 1.

Turning now to FIG. 2, the power door operator 10 comprises an elongate closer body housing, generally indicated at 34, mounted on the top door frame member 16 along a generally horizontal axis A. The housing 34 is rectangular in construction and comprises a top wall 36, a bottom wall 38, a rear wall 40 which is placed adjacent the top door frame member 16 when mounting the housing 34 thereto, a front wall 42 and two end walls 44, 46. The housing 34 is provided for securing together the internal components of the power door operator 10 and for concealing them.

As shown, housing 34 supports therein a linear drive assembly, generally designated at 48, and a door closing assembly, generally designated at 50. A drive, generally designated at 52, powers the operation of the linear drive assembly 48 which in turn powers the door closing assembly 50. Turning first to the linear drive assembly 48, it comprises a chamber 54 having a cylindrical wall 56 and two end plugs 58, 60 which threadably engage the open ends of the wall 56. The right-hand end plug 58 is threadably mounted at one end thereof to the door closing assembly 50 having mounting pads 64 for attaching the linear drive and door closing assemblies 48, 50 to the housing 34 (as by screw fasteners 66). A power screw 68 is received within the chamber 54 through an opening (not designated) within the left-hand end plug 60, the power screw 68 having a threaded end portion 70 which is received within the chamber 54.

The threaded end portion 70 of the power screw 68 is received through a threaded bore (not designated) of a piston 72 which moves linearly from end-to-end along the horizontal axis A as the power screw 68 rotates. Piston 72 moves linearly within the chamber. Alternatively, the piston 72 and piston head 74 can be formed as one-piece. The piston head 74 has an outwardly facing surface 76 which engages a rod 78 received through an opening (not designated) provided in the right-hand end plug 58. The rod 78 is supported by a bearing and seal wiper arrangement 80 housed within the end plug 58 for ensuring oil from the door closing assembly 50 does not enter the separate chamber 54. The purpose of the rod 78 will be described in greater detail as the description of the invention continues. A thrust bearing 82 and back-up washer 84 are also provided within the chamber 54, the thrust bearing 82 supporting the power screw 68 and the back-up washer 84 engaging the piston 72 when the piston is in the left-hand position illustrated in FIG. 2.

The arrangement is such that the rotation of the power screw 68 causes the piston 72, piston head 74 and rod 78 to move end-to-end along the power screw 68. For example, when rotating the power screw 68 in a clockwise direction, the piston 72, piston head 74 and rod 78 move linearly from left to right along the horizontal axis A as shown in FIG. 2. Conversely, when the power screw 68 is rotated counterclockwise, they move from right-to-left. Note that rod 78 moves right-to-left due to the door closer spring force and is not driven in that direction by the power screw.

The drive 52 is mounted on the housing 34 in any suitable manner (e.g., as by welding or by bolt fasteners) in a position adjacent the other end portion 86 of the power screw 68. The drive 52 has a shaft 88 suitably connected by a coupler, generally indicated at 90, to the power screw 68 for powering the rotational movement of the power screw 68 about the horizontal axis A. As illustrated in FIG. 2, the drive 52 further includes a housing 92 attached to the housing 34 and suitable means (not shown) for driving the rotational movement of its shaft 88 which provides a rotational force on the power screw 68. Thus, the drive 52 powers the linear, end-to-end movement of the piston 72, piston head 74 and rod 78. The drive 52 can be electrically, pneumatically, or hydraulically powered. The control device 18 is suitably connected to the drive 52 by wire 26 for providing the electrical communication between the two components and for powering the operation of the drive 52. Preferably, the drive 52 is constructed and arranged such that the power screw 68 is capable of freely rotating when the drive 52 is not operating. More specifically, the drive 52 is capable of rotating the power screw 68 when opening the door 12 and allows the power screw 68 to freely rotate axially about horizontal axis A when the power door operator 10 is not in use. This enables a person to manually open the door 12 without the aid of the power door operator 10.

The coupler 90 illustrated in FIG. 2 can embody a clutch mechanism which couples the drive 52 and power screw 68. The clutch mechanism 90 enables the door 12 to be moved to its closed position in opposition to the rotational movement of the shaft 88 of the drive 52 and the power screw 68 without causing damage to the drive 52. This arrangement prevents damage to the drive 52 and power door operator 10 when a person attempts to close the door 12 during the opening action of the power door operator 10.

Still referring to FIG. 2, the door closing assembly 50 comprises a hydraulic cylinder 94 threadably attached at one of its ends to the other end of the annular support bracket 62. The hydraulic cylinder 94 also includes a cylindrical wall 96 having a threaded end portion 98 for securing the hydraulic cylinder 94 to the support bracket 62 and an end plug 100 for closing the open end of the hydraulic cylinder 96. The annular support bracket 62 includes a chamber portion 102 co-centric with the hydraulic cylinder 94 for receiving a piston member 104 therein. As shown the piston member 104 comprises a first piston 106 having a check valve 108 provided therein for allowing oil in the hydraulic cylinder to escape to the left of the first piston 106 as pressure in the chamber to the right of the first piston 106 increases. The right hand end of the rod 78 engages the first piston 106 for moving it from left to right along the horizontal axis A upon activation of the drive 52. The piston member 104 also comprises a second piston 110 and rack portion 112 integrally formed with the first piston 106, the rack portion 112 being provided in between the first and second pistons 106, 110. The second piston 110 also has a check valve 114 provided therein for allowing oil in the hydraulic cylinder 94 to escape to the right of the second piston 110 as pressure in the chamber to the left of the second piston 110 increases.

The piston member 104 is slidably moveable along the horizontal axis A within the chamber portion 102 of the support bracket 62 and is positioned within the chamber portion 102 such that the rack portion 112 of the piston member 104 engages a pinion 116 provided within the chamber portion 102 of the support bracket 62 along a vertical axis B. The rack portion 112 has teeth 118 formed therein which mesh with teeth 120 formed in the pinion 116. A pair of bearings, each designated 122, secure the pinion 116 to the support bracket 62. The bottom portion of the pinion 116 is secured to the first link arm 28 by any suitable means so long as the pinion 116 can exert the rotational force necessary for rotating the first link arm 28 and open the door 12. The arrangement is such that the piston member 104 is movable from a first (left-hand) position as illustrated in FIG. 2 to a second (right-hand) position for rotating the pinion 116 between a closed door position and an opened door position, respectively. This movement is caused by the activation of the drive 52 which rotates the power screw 68 for moving the slider block 72, air piston member 74 and rod 78 to the right. The rod 78 engages the first piston 106 of the piston member 104 for moving the piston member 104 (and rack portion 112) from its first position to its second position.

For moving the piston member 104 back to its first position, a spring 124 is disposed within the hydraulic cylinder. The spring 124 has one end engaging the end plug 100 of the hydraulic cylinder 94 and its other end engaging the second piston 110 of piston member 104. The spring 124 provides a resilient force on the piston member 104 for moving the piston member 104 back to its first position when the drive 52 is deactivated and the power screw 68 is capable of rotating freely. More specifically, the spring 124 is compressed as the piston member 104 moves from its first to second position. Upon deactivation of the drive 52 (wherein the power screw 68 is capable of rotating freely), the spring 124 moves the piston member 104 (and rack portion 112) to its first position for closing the door 12. During this movement, the first piston 106 of the piston member 104 pushes the rod 78 to the left which in turn pushes the piston head 74 and piston 72 to the left. Thus, it should be observed that the power door operator 10 of the present invention has a built-in automatic door closer.

A spring adjuster 126 is housed within the end plug 100 of the hydraulic cylinder 94 for adjusting the compression force of the spring 124. This feature adjusts the closing force that the spring 124 exerts on the piston member 104 when it moves it back to its first position. By increasing the closing force of the spring 124, the closing action of the door 12 is quickened. Conversely, by decreasing the closing force of the spring 124, the closing action of the door 12 is slowed down. The spring adjuster 126 comprises a shaft 128 received in a bore (not designated) formed in the end plug 100, an adjusting nut 130 provided at the end of the shaft 128 outside the hydraulic cylinder 94, and washer 132 which engages the spring 124. By tightening the adjusting nut 130, the washer 132 is moved towards the spring 124 for compressing the spring 124 thereby increasing the closing force.

During operation and use of the power door operator 10 illustrated in FIG. 2, as a person approaches the door 12 in a closed position, the person may selectively press the switch 22 for opening the door 12 automatically. Upon pressing the switch 22, the control device 18 powers the operation of the drive 52 for moving the door 12 between a closed position to an open position. More specifically, the drive 52 rotates the power screw 68 for moving the piston 72, piston head 74 and rod 78 to the right. The rod 78 engages the first piston 106 of the piston member 104 in the hydraulic cylinder 94 for moving the piston member 104 from its shown first position in which the door 12 is closed to a second position in which the door 12 is fully opened. The control device 18 can be programmed for opening the door 12 at any desired angle of rotation instead of its fully opened position. The control device 18 can also be programmed to hold the door 12 open for a selected period of time for enabling the person to go through the door opening without the door 12 impeding his or her access. After the selected period of time has elapsed, power to the drive 52 is cut-off and the spring 124 provided in the hydraulic cylinder 94 exerts a closing force on the piston member 104 for moving it back to its first position to close the door 12.

Figure 3:
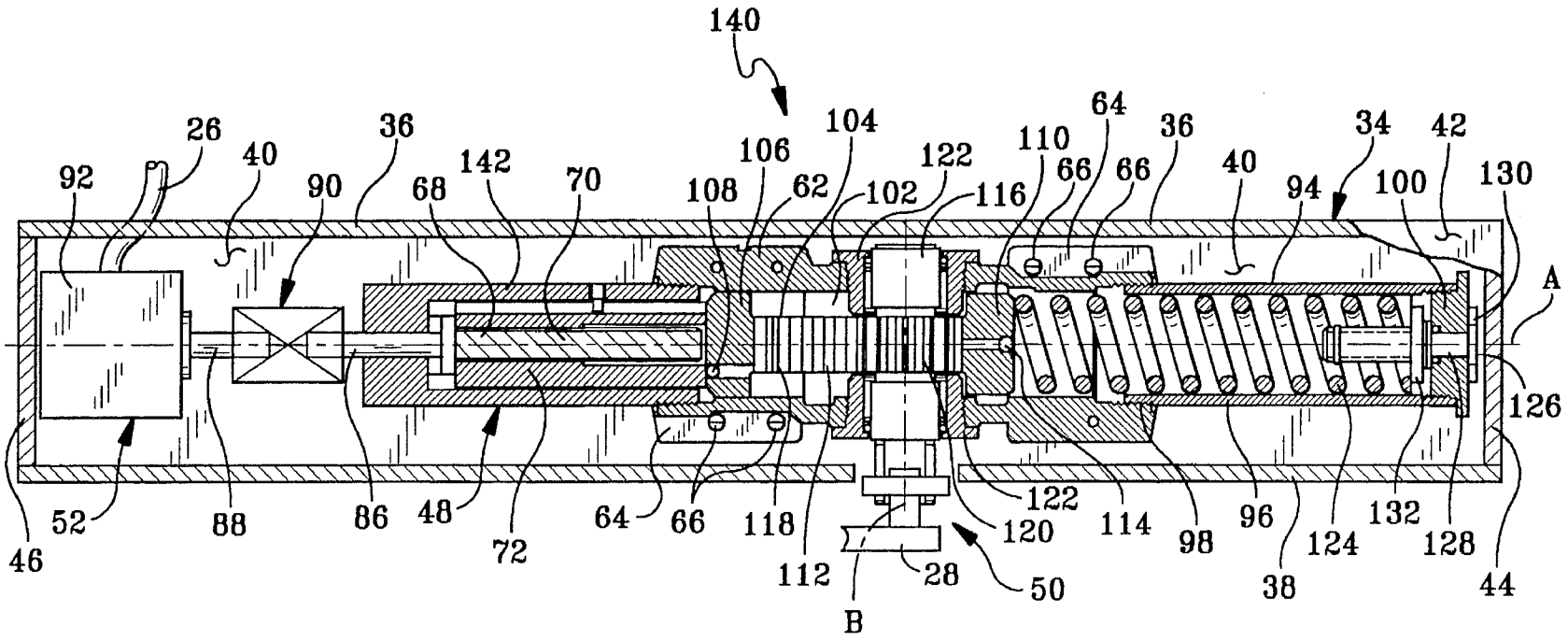
FIG. 3 is a view similar to FIG. 2 illustrating a power door operator of another preferred embodiment.

FIG. 3 illustrates an alternative embodiment to the present invention wherein similar reference numbers are used to designate similar parts identified in FIG. 2. As shown, a linear drive power door operator, generally designated at 140, also comprises a drive 52, a coupler 90 and a power screw 68. The power screw 68 threadably engages a piston 72 which engages the first piston 106 of the piston member 104. The primary difference between the embodiment illustrated in FIG. 3 and the embodiment illustrated in FIG. 2 is that the chamber 54 of the linear drive assembly 48 is incorporated into the hydraulic cylinder 142. Thus, the entire system operates under hydraulic conditions and there is no need to seal the air cylinder from the hydraulic cylinder. Also, the provision of the piston head 74 and rod 78 are also eliminated in this embodiment. The primary benefit of such an arrangement is that it is less costly to manufacture since there are fewer parts. The piston 72 engages the piston member 104 for moving the rack portion 112 of the member 104 to its second position thereby rotating the pinion 116 which in turn rotates the first link arm 28 to open the door The spring 124 is provided in the hydraulic cylinder 94 to provide a closing force on the piston member 104 for moving it to its first position thereby closing the door 12.

Figure 4:
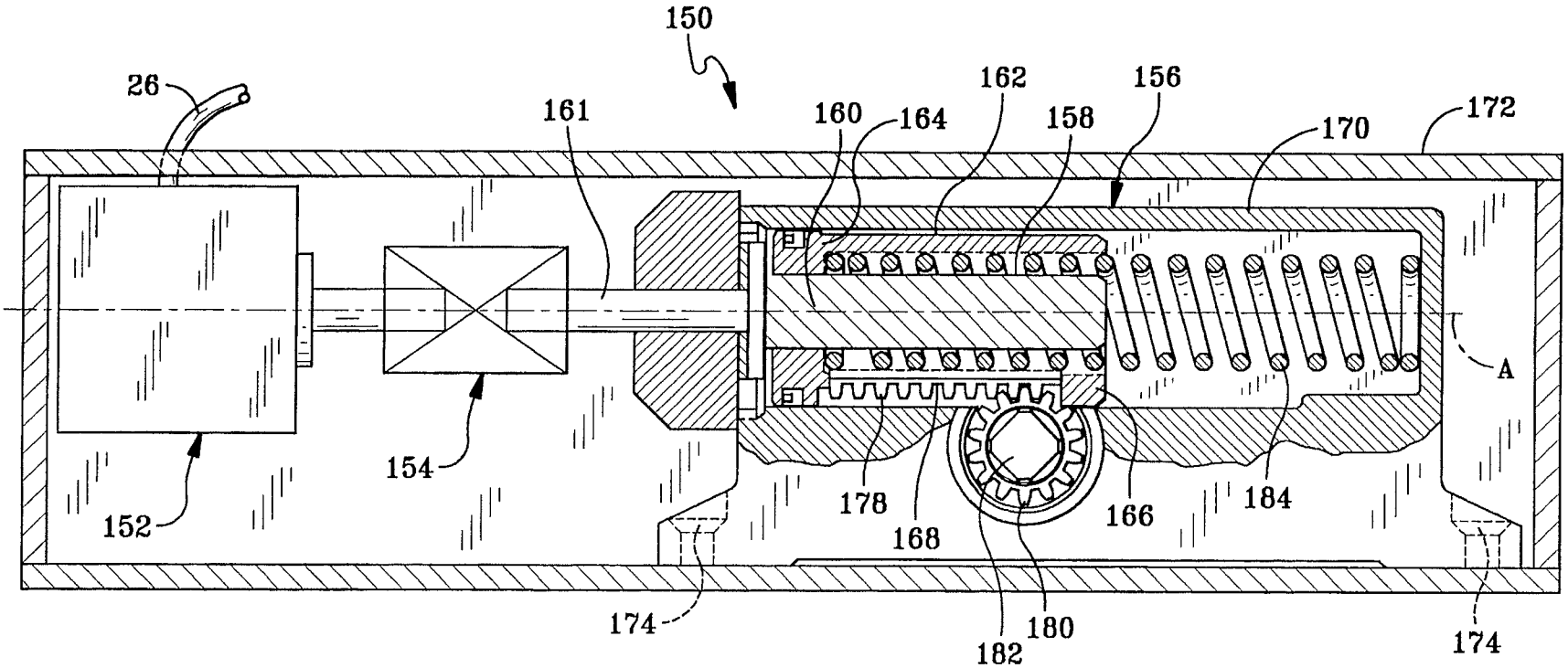
FIG. 4 is a view similar to FIGS. 2 and 3 illustrating yet another preferred embodiment.

FIG. 4 illustrates yet another embodiment of the present invention comprising a linear drive power door operator, generally designated as 150. As shown, the linear drive power door operator 150 is a simplified version of the power door operators 10, 140 illustrated in FIGS. 2 and 3, respectively. Power door operator 150 comprises a drive, generally indicated at 152, a coupler (or clutch mechanism), generally indicated at 154, and a door actuating assembly, generally indicated at 156. The door actuating assembly 156 comprises a power screw 158 having a threaded portion 160 and a non-threaded portion 161 connected to the coupler 154, and a piston 162 having an end portion 164 with a threaded bore (not designated) which threadably engages the threaded portion 160 of the power screw 158 and a rack-securing portion 166 for receiving a rack portion 168 therein. As shown, the end portion 164 and rack-securing portion 166 are integrally formed with each other. The rack portion 168 can be formed integrally with the rack-securing portion 166 or be attached thereto by suitable means such as welding. The end portion 164 of the slider block 162 is received in a hydraulic cylinder 170 and is linearly movable from side-to-side within the hydraulic cylinder 170 upon the activation of the drive 152 and the rotational movement of the power screw 158. The hydraulic cylinder 170 is secured to a track housing 172 of the power door operator 150 by a pair of screw fasteners 174. The rack portion 168 has teeth 178 which mesh with teeth 180 of a pinion 182 suitably secured in the hydraulic cylinder 170. The pinion 182 is secured to the hydraulic cylinder 170 in a manner similar to the securement of the pinions 116 of power door operators 10, 140 to their respective support brackets 62.

The piston 162 is movable within the hydraulic cylinder 170 between a first (left-hand as illustrated in FIG. 4) position in which the door 12 is closed and a second (right-hand) position in which the rack portion 168 rotates the pinion 182 for opening the door 12. A spring 184 is disposed within the hydraulic cylinder 170 for biasing the piston 162 back to its first position. It should be noted that drive 152 is also constructed for enabling the power screw 158 to freely rotate when the drive 152 is inoperative. This enables a person to manually open the door 12 without the aid of the power door operator 150.

It should be observed that the linear drive power door operators 10, 140 and 150 illustrated in FIGS. 2–4 of the drawings, respectively, are each compact in design, relatively easy to manufacture and cost-efficient to manufacture and install.

While this invention has been illustrated and described in accordance with a preferred embodiment, it is recognized that variations and changes may be made therein without departing from the invention as set forth in the following claims.

Having described the invention, what is claimed is:

1. A linear drive power door operator for selectively and automatically opening and closing a door swingably mounted on a door frame, said power door operator comprising:

a power screw extending along a horizontal axis;

a drive connected to the power screw for powering the rotation of the power screw about said horizontal axis;

a piston having a threaded bore threadably engaging said power screw, said piston being moved linearly along said horizontal axis upon activation of the drive and the rotational movement of the power screw;

a rack having teeth, said piston engaging said rack for moving the rack linearly from end-to-end upon the linear movement of the piston;

a pinion having teeth threadably engaging the teeth of the rack, said pinion being rotatable about a vertical axis upon the end-to-end linear movement of the rack;

at least one link arm pivotally connected at one of its ends to the pinion and pivotally connected at its other end to the door; and a control for controlling the operation of the drive for moving the door between a closed position and an open position, said control activating said drive for moving the piston and the rack from a first position in which the door is closed to a second position in which the door is fully open, and any position in between.

2. A power door operator as set forth in claim 1 further comprising a spring engageable with said rack for biasing the rack and the piston to their said first position thereby closing the door when it is in an open position and the drive is inoperative.

3. A power door operator as set forth in claim 2, said drive rotating the power screw when opening the door and allowing the power screw to freely rotate axially when the power door operator is not in use thereby enabling said spring to move the piston and the rack to their first position.

4. A power door operator as set forth in claim 2, said piston engaging a piston head slidably movable within a chamber disposed along said horizontal axis, said piston head engaging a rod which moves the rack between its first and second position.

5. A power door operator as set forth in claim 4, said rod engaging a first hydraulic piston slidably movable within a hydraulic cylinder disposed along said horizontal axis, said first hydraulic piston engaging said rack for moving the rack between its first and second position.

6. A power door operator as set forth in claim 5, said first piston being integrally formed with said rack at one end thereof.

7. A power door operator as set forth in claim 6, said rack having a second piston integrally formed therewith at its other end.

8. A power door operator as set forth in claim 7, said spring engaging said second piston for moving the rack and pistons to their first position.

9. A power door operator as set forth in claim 1, said control being in electrical communication with a switch accessible at a location remote from said door for activating said control which opens the door.

10. A power door operator as set forth in claim 1 further comprising a clutch mechanism which couples the power screw and the drive, said clutch mechanism enabling the door to be moved to its closed position in opposition to the rotational direction of the drive without causing damage to the drive.

11. A linear drive power door operator for selectively and automatically opening and closing a door swingably mounted on a door frame, said power door operator comprising:

a power screw extending along a horizontal axis;

a drive connected to the power screw for powering the rotation of the power screw about said horizontal axis;

a piston having an end portion with threaded bore threadably engaging said power screw and a rack portion with teeth formed therein, said piston being moved linearly from side-to-side along said horizontal axis upon activation of the drive and the rotational movement of the power screw;

a pinion having teeth threadably engaging the teeth of the rack portion of said piston, said pinion being rotatable about a vertical axis upon the end-to-end linear movement of the rack portion of the piston;

at least one link arm pivotally connected at one of its ends to the pinion and pivotally connected at its other end to the door; and a control for controlling the operation of the drive for moving the door between a closed position and an open position, said control activating said drive for moving the piston and the rack portion from a first position in which the door is closed to a second position in which the door is fully open, and any position in between.

12. A power door operator as set forth in claim 11 further comprising a spring engageable with said rack portion of said piston for biasing the piston and rack portion to their said first position thereby closing the door when it is an open position.

13. A power door operator as set forth in claim 12, said drive rotating the power screw when opening the door and allowing the power screw to freely rotate axially when the power door operator is not in use thereby enabling said spring to move the piston and rack portion to their first position.

14. A power door operator as set forth in claim said control being in electrical communication with a switch accessible by a person for activating said control which opens the door.

15. A power door operator as set forth in claim 11 further comprising a clutch mechanism which couples the power screw and the drive, said clutch mechanism enabling the door to be moved to its closed position in opposition to the rotational direction of the drive without causing damage to the drive.

16. A power door operator as set forth in claim 11, said piston further having a rack-securing portion for securing the rack portion to the piston, said rack-securing portion being integral with the end portion of the piston.

* * * * *